US008376911B2

(12) United States Patent
Ogg et al.

(10) Patent No.: US 8,376,911 B2
(45) Date of Patent: Feb. 19, 2013

(54) AUDIO INTERVAL TRAINING DEVICE

(75) Inventors: Felix H. G. Ogg, Eindhoven (NL); David P. L. Simons, Veldhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1456 days.

(21) Appl. No.: 10/598,074

(22) PCT Filed: Feb. 16, 2005

(86) PCT No.: PCT/IB2005/050586
§ 371 (c)(1),
(2), (4) Date: Aug. 17, 2006

(87) PCT Pub. No.: WO2005/082471
PCT Pub. Date: Sep. 9, 2005

(65) Prior Publication Data

US 2008/0214358 A1 Sep. 4, 2008

Related U.S. Application Data

(60) Provisional application No. 60/546,076, filed on Feb. 19, 2004.

(51) Int. Cl.
*A63B 71/00* (2006.01)

(52) U.S. Cl. ..... 482/9; 482/2; 482/148

(58) Field of Classification Search ..... 482/1–9, 482/148; 600/519
See application file for complete search history.

(56) References Cited

U.S. PATENT DOCUMENTS 3,863,626 A * 2/1975 Huber ..... 600/519
4,788,983 A * 12/1988 Brink et al. ..... 600/547
5,215,468 A * 6/1993 Lauffer et al. ..... 434/236
5,314,389 A * 5/1994 Dotan ..... 482/3
5,527,239 A * 6/1996 Abbondanza ..... 482/8
5,577,510 A * 11/1996 Chittum et al. ..... 600/522
5,810,737 A * 9/1998 Dardik ..... 600/500
5,879,270 A * 3/1999 Huish et al. ..... 482/8
5,986,200 A * 11/1999 Curtin ..... 84/609
6,013,007 A * 1/2000 Root et al. ..... 482/8
6,163,718 A * 12/2000 Fabrizio ..... 600/519
6,230,047 B1 * 5/2001 McHugh ..... 600/519
6,345,197 B1 * 2/2002 Fabrizio ..... 600/519
6,572,511 B1 * 6/2003 Volpe ..... 482/4
6,607,493 B2 8/2003 Song
6,634,992 B1 * 10/2003 Ogawa ..... 482/8
6,672,991 B2 * 1/2004 O'Malley ..... 482/8

(Continued)

FOREIGN PATENT DOCUMENTS

EP 1101511 A 5/2001
EP 1251441 A 10/2002

(Continued)

OTHER PUBLICATIONS

"Affective Wearables" by Picard R.W. et al, Wearable Computers, Oct. 13, 1997, pp. 90-97.

*Primary Examiner* — Rinaldi Rada
*Assistant Examiner* — Andrew M Tecco

(57) ABSTRACT

There is provided an audio interval training device, including a sensing unit to obtain a parameter of a user in physical exercise, a memory to store a plurality of audio signals having predetermined tempos; and a processing unit configured to (1) receive a first and second target parameter value, (2) select from the plurality of audio signals a first and second audio signal having respective tempos, (3) alternatively rendering the first and second audio signals, wherein a respective audio signal is rendered to the user corresponding to the first and second target parameter value, as determined by the processing unit using the parameter from the sensing unit.

17 Claims, 2 Drawing Sheets

U.S. PATENT DOCUMENTS

| | | | | |
|---|---|---|---|---|
| 6,736,759 | B1 * | 5/2004 | Stubbs et al. | 482/8 |
| 6,805,656 | B2 * | 10/2004 | Ogawa | 482/8 |
| 6,808,473 | B2 * | 10/2004 | Hisano et al. | 482/8 |
| 6,837,827 | B1 * | 1/2005 | Lee et al. | 482/8 |
| 6,852,068 | B2 * | 2/2005 | Ogawa | 482/8 |
| 7,076,291 | B2 * | 7/2006 | Pulkkinen et al. | 600/523 |
| 7,175,601 | B2 * | 2/2007 | Verjus et al. | 600/500 |
| 7,177,672 | B2 * | 2/2007 | Nissila | 600/519 |
| 7,207,935 | B1 * | 4/2007 | Lipo | 600/28 |
| 2002/0091049 | A1 | 7/2002 | Hisano | |
| 2006/0102171 | A1 * | 5/2006 | Gavish | 128/95.1 |

FOREIGN PATENT DOCUMENTS

| | | | |
|---|---|---|---|
| EP | 1512370 | A1 | 3/2005 |
| JP | 7236708 | A | 9/1995 |
| JP | 09131325 | A | 5/1997 |
| JP | 10063265 | A | 3/1998 |
| JP | 2001299980 | A | 10/2001 |
| JP | 2003108154 | A | 4/2003 |
| JP | 2004209157 | A | 7/2004 |
| WO | 9844996 | A1 | 10/1998 |
| WO | W02004072767 | A | 8/2004 |

* cited by examiner

AUDIO INTERVAL TRAINING DEVICE

CROSS REFERENCE TO RELATED APPLICATION

This application claims the benefit of U.S. provisional application Ser. No. 60/546,076 filed Feb. 19, 2004, which is incorporated herein in whole by reference.

The present invention relates to a device and methods using an audio (music) signal, a parameter of a user, such as pulse rate (heartbeat), and musical listening devices for interval training. More particularly, the present invention relates to a device and method capable of selecting an audio signal corresponding to an appropriate tempo, for example, beats per minute (BPM) to achieve two interval exercise levels.

Numerous physical exercise programs and, in particular, running or jogging performed by individuals are significantly more effective in a particular range of heart beat rates. The required heart beat rates vary for the individuals with different ages and health factors. Moreover, individual heart beat rates that drop to a specific low level, result in physical exercises that can have only a slight influence on them. Further, individual heart beat rates that go beyond an upper limit level, result in exercises that can have a harmful influence on them. Accordingly, people who start physical exercise programs should exercise in amounts suitable for them according to their physical status.

Heart beat (or pulse rate) analysis devices are used as an exercise amount measurement. They measure heart beat rate (or pulse) of an individual in exercise in heart beats per minute (pulse), and compare the measured number with a standard table, so that one measures the physical exercise as weak, medium, or strong for oneself. Further, sports literature is available with specific tables for goals such as fat-burning/weight loss, energizing exercise, cardiovascular training or speed training. Depending on one's weight, height, body fat percentage, age, gender (etc.) one can find the ideal pulse pace for the goal at hand.

Particularly athletes, who want to track their improvements, and thus stay motivated to follow through, find heartbeat monitoring tools motivating and stimulating.

Conventional heart beat analysis devices, such as the Polar™ sportswatch, are known to give audible feedback (e.g. a beep) when the pulse of a user/athlete exceeds a target pulse threshold (upper or lower). It thereby signals the user to adjust the exercise strength accordingly to return to the appropriate training zone or level.

However, such conventional heartbeat analysis devices suffer from a number of limitations. For example, many users find the beeping annoying and as a result are known to turn the beeping off altogether. Further, other athletes use portable music playback devices, such as MP3 players, during exercise routines and cannot hear the beeping.

Further, listening to music while performing physical exercise is very popular. However, a problem of listening to music while exercising is that the music often has a tempo which is out of synchronization with the pace of the person exercising. Modern day pop music is generally supported by a clear drumbeat that can be followed in the pace of a physical exercise. Soldiers march to the beat of a song and in the same way Roman slaves rowed their boats to a drumbeat. Athletes enjoy moving along the beat of music playing, since this helps them in keeping a constant pace. Music is a powerful tool to increase the performance of athletes if they are sensitive to it.

Moreover, many users/athletes often use a technique known as interval training. During interval training the athlete alternates between two levels of exercise intensity (pace). For instance, the athlete sets a maximum heart rate and a minimum heart rate. The physical exercise or training consists of a small warming up phase, followed by several interval sets. First, the athlete puts in a maximum (e.g. 100%) effort, for example sprinting, until his heart rate reaches the target maximum. Thereafter, the athlete tries to recuperate as fast as possible, which means he exerts a mild exercise activity until his heart rate falls below the minimum target. These alternating steps are repeated several times.

In a similar way interval training can be performed based on time intervals rather than heart rate measurements. In that case the exercise is to put in a full effort (e.g. sprinting) for a small fixed period (e.g. 20 seconds) alternated by a second period of recuperation (e.g. 2 minutes). In this way a similar cycle is attained, be it less dependent on the actual state of the body.

Accordingly, there is a need for an apparatus that enables music supported effective interval training in a non-intrusive, motivating way The present invention is directed to a system and method for an audio interval training device and which enable a user to select two (a high and low) intensity levels for interval training and provides an audio signal that is correlated to the selected interval exercise program or routine to achieve the target performance levels. The two intensity levels can be based on two heartbeat rates or two durations/time intervals.

The audio signals are ordered based on their tempo, for example, a measurement based on a beat per minute (BPM) value. The audio signal ordering can be conducted either by the heart beat interval training apparatus, or by an external device, such as a PC, and then transferred to the heart beat interval training apparatus. An audio signal is selected having a tempo (e.g. BPM) that paces the user to the current phase of exercise (e.g. sprinting). The audio signal comprises an MP3, WAV or WMA file, and the like, generally containing music.

In accordance with the principles of the present invention an audio interval training device is provided including a sensing unit to obtain a parameter of a user in physical exercise, a memory to store a plurality of audio signals having predetermined beat per minute values; and a processing unit configured to (1) receive a first and second target parameter value (2) select a first and second audio signal having respective tempos, (3) alternatively rendering the first and second audio signals, wherein a respective audio signal is rendered to the user corresponding to the first and second target parameter value, as determined by the processing unit using the parameter from the sensing unit.

The present invention is more fully understood by reference to the following detailed description of a preferred embodiment in combination with the drawings identified below.

In the following description, for purposes of explanation rather than limitation, specific details are set forth such as the particular architecture, interfaces, techniques, etc., in order to provide a thorough understanding of the present invention. However, it will be apparent to those skilled in the art that the present invention may be practiced in other embodiments that depart from these specific details. As used herein the terms "pulse" means a heart-beat rate, "tempo" of an audio signal is, for example in BPM, and "pace" refers to an exercise tempo.

This application is filed concurrently with co-pending U.S. patent application "Audio Pacing Device", Ser. No. 10/598,078, filed Aug. 17, 2006, for F. H. G. Ogg and D. P. L. Simons, and is incorporated by reference herein.

Figure 1:
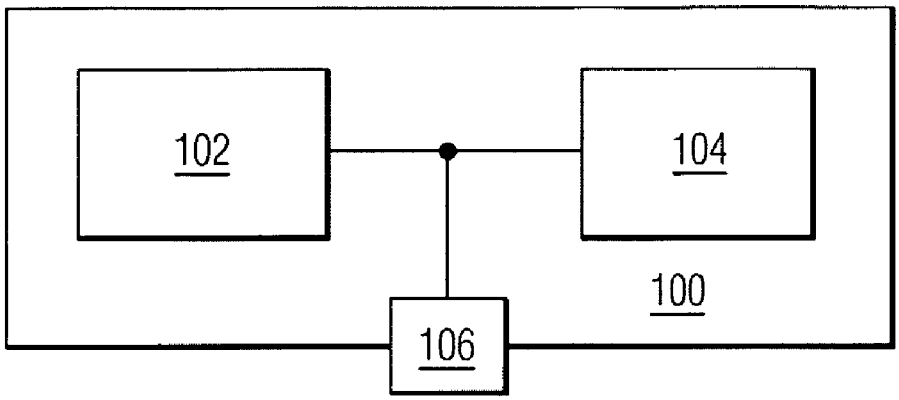
FIG. 1 is a view for showing a audio interval training device according to an embodiment of the present invention.

Referring to the drawings and, in particular, FIG. 1, there is shown an audio interval training device in accordance with the present invention generally represented by reference numeral 100.

As shown in FIG. 1, the present invention includes a processing unit 102, a sensing unit 104, for example a heart rate monitor or timer device, (hereinafter for exemplary purposes referred to as a "heart rate monitor 104"), and input/output port 106. The processing unit 102 performs the functions of: (1) receiving and storing parameter information of a user in physical exercise (hereinafter for exemplary purposes referred to as "heart rate"), (2) storing BPM rated audio signals and (3) selecting an audio signal with a particular BPM according to user's exercise program. The parameter information of a user in physical exercise may include any parameter related to a user physical status or condition, for example, time-intervals, heart rate or a step-rate measurement, speed measurement (in m/s), for example using the electronic speed sensor on sports bicycles, rowing trainers or any other kind of digital fitness equipment, the sit-up speed from a sit-up trainer equipped with a sensor to count the number of sit-ups per minute, similarly a sensor on a strap-on belt on an ankle/wrist/head/waist etc. (for aerobics ground exercises), providing a rating. In addition, processing unit 102 may also digitize received broadcast signals and encode them according to a particular coding scheme (e.g. MP3, WAV, MPEG-4 and the like) and BPM-rate received audio signals. Alternatively, as well be apparent to those skilled in the art, the processing unit 102 may also include an integrated sensing unit.

The processing unit measures a user's exercise effects by receiving and analyzing heart rate information of a user in physical exercise. For example, data analysis is performed for a change rate of the number of heart beats by time (second/minute/hour), a change rate of the number of heart beats by unit time (day/month/year), a suitable exercise intensity proposal based on a change of the number of heart beats, a proposal of the objective heart beats (a proper exercise amount) based on ages, gender, heights, and weights, an indication of an exercise improvement degree based on the change of the number of heart beats, a total amount of calories consumed during exercise, what percent of the total consumed calories amount comes from the body fat, and so on.

The processing unit 102 may be manufactured in a variety of designs, such as: (1) to be worn on the wrist like a wrist watch in one body with the heart rate monitor 104, (2) to be attached on the front of the user's sporting coat, (3) to be hung around the neck of a user by a string like a stop watch, and (4) to be integrated in a wearable fabric or clothing-type device. In particular, the use of integrated electronic and conductive fibers in various sewn or woven fabrics used as conductive traces, bio-sensors, electrodes, and other wearable electronic devices are well known. For example, in the case of a Wearable Heart Rate Monitor (WHRM) device for general sport applications, the electrodes can be fully made of fabric and can be fully integrated into a garment such as a running top. The electronics though that collect the data from the electrodes and transmit them wirelessly to a watch or similar device are contained in a separate small unit which can be attached onto the garment in such a way that it can make good electrical contact with the fabric electrodes.

The heart rate monitor 104 is connected to the processing unit 102 in a wire, wireless or wearable fabric way, and performs a function of measuring heart beats of a user in physical exercise and transferring the sampled heart beats to the processing unit 102. The heart rate monitor can be any conventional unit, for example the Polar™ Sportswatch, by Polar Electronics. Such heart rate monitor 104 is carried on a wrist like a wrist watch.

The input/output port 106 is connected to the processing unit 102 and heart rate monitor for exchanging data, and includes the functions of transferring digitalized music files to the processor 102 and outputting audio signals, selected based on their tempo (e.g. their BPM rating).

The processing unit enables heart rate interval training. In particular, two separate audio signals (e.g. MP3 songs) are selected by a user via input/output port 106. The first audio signal provides a first pacing level for an upper (or maximum) heart rate. The second audio signal provides a second pacing level for a lower (or minimum) heart rate. During a first phase of the interval training the first audio signal is rendered to a user to increase the user's heart rate. During a second phase of the interval training the second audio signal is rendered to the user to decease the user's heart rate. Alternating between the two audio signals is performed instantaneously (optionally with a few seconds of cross-fade). The rendered audio signal is paused, and the other audio signal is continued where it was paused the previous time. The heart rate monitor 104 is used to determine when to alternate the audio signals. Advantageously, the user obtains a clear indication, through the differing tempo audio signals, to exercise at either maximum or minimal intensity.

Figure 2:
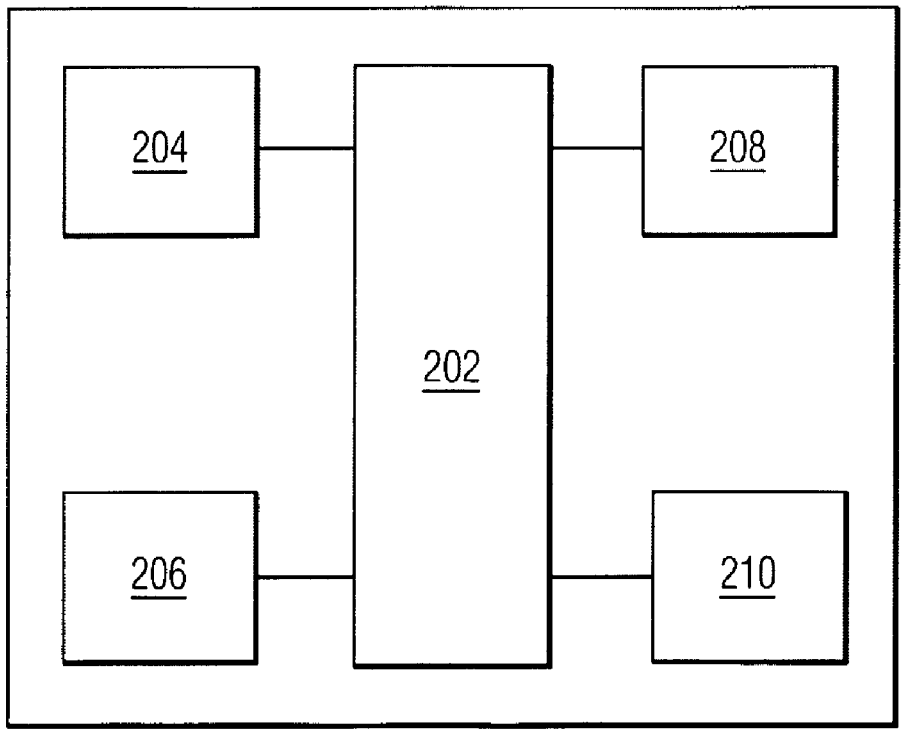
FIG. 2 is a block diagram for showing an internal structure of the processing unit FIG. 1.

FIG. 2 is a component diagram of the processing unit 102 of FIG. 1 according to an embodiment of the present invention.

As shown in FIG. 2, the processing unit according to the present invention has a control unit 202, an output unit 204, a storage unit 206, a sensing signal receiving unit 208, and an input unit 210. The control unit 202 includes a conventional microcomputer and a digital signal processor (DSP) (not shown). The output unit 204 includes an audio output unit and may include an indication unit (not shown). The sensing signal receiving unit 208 receives sensing information (below by example referred to as heart rate) from the sensing unit 104 and transfers it to the control unit 202. As indicated above, a conventional heart rate monitor can also be integrated into the processing unit.

Storage unit 206 contains a group of BPM categorized audio signals, for example MP3s. In addition, storage unit 206 may contain programmed exercise routines or target exercise levels, as further described below, which are received using input unit 210.

Tempo-relative ordering of the audio signals can be performed by the processing unit or off-line and downloaded to the heart rate interval device. The BPM categorized audio signals can be input into the storage unit 206 using any conventional manner (e.g. downloaded from a PC, wirelessly transmitted, etc.) A conventional tool that does automatic (off-line) BPM analysis upon audio files to measure the musical tempo, (as well as dynamic (on-line) tempo adjustments, discussed below) is the PCDJ-Red product from Visiosonic. This tool will determine the average BPM of a song to an accuracy of 0.01 BPM (such as 86.56 beats per minute). Once an audio signal is tempo-analyzed, the BPM value it is stored with the audio signal, for example in the header of the audio signal. In particular, in the case of MP3 files, the BPM value is stored in the MP3 file, as an ID3v2 BPM tag, which can be read by other applications subsequently. Thus, for example, MP3s can be downloaded to the device that are searched (e.g. on the Internet) for their ID3v2 BPM tag values. If no value for their BPM is available, it is generated by using BPM analysis algorithms in the device.

The control unit 202 stores the heart rate received into a storage unit 206, analyzes the number of heart beats received, compares it with a predetermined reference value (e.g. target level or programmed exercise program), and decides whether to either (1) toggle intensity phase (to high/low intensity) by selecting and consequently rendering a newly selected (or previously paused) audio signal having a tempo corresponding to the target intensity phase, or (2) to remain in the current intensity phase by continuing the rendering of the current audio signal or by selecting a similar tempo (BPM) audio signal. In either case rendering of the audio signal is performed using output unit 204.

The appropriate heart rates the user should attain are predetermined by the user or by any other conventional manner. Accordingly, an objective number of heart beats as a reference value range which can evaluate what extent of heart beats corresponds to a high-strength exercise, a medium-strength exercise, or a low-strength exercise. Moreover, established values for heart rates during physical exercise can be used that factor the age, sex, height, weight, etc., of a user. In addition, the processing unit can store (in storage unit 206) programmed training routines, using the above factors, for a user wherein heart rate levels are established. The programmed training routines can be input into the processing unit in any conventional manner. For example, a heartbeat sensor, such as the Polar™ sportswatch, can be manually programmed with a training zone (two heart beat values).

For example, the control unit 202 receives a heart rate of a user (an individual in physical exercise) from the sensing receiving unit 208, compares the received heart rate with the predetermined objective heart rate, and determines an appropriate tempo/BPM audio signal to output to help achieve the desired user heart rate. When a particular audio signal, or song/music ends, while the user is in an exercise program, another audio signal with a similar tempo/BPM is selected from the store group of audio signals.

The processing device is also enabled to receive input from a user, using the input unit 210, for example a button, during exercise to denote particular audio signals or songs that support the exercise or training. Also, the user can use the input unit 210 to denote favorite audio signals. This in turn will enhance the probability that the particular audio signal with be selected during a later exercise session. For example, once an audio signal is denoted, if an audio signal is needed in the future within a predetermined range (e.g. +/−10%) of the denoted audio signal's BPM, it will be selected.

In a similar manner, the user can store an indication of the type of exercise, for example, the type of sport, running, rowing, cycling, etc., along with the denoted audio signal. Thus, the processing device records the most appropriate audio signal for each type of sport or exercise for a user. This, in turn, shortens the time to select an appropriate audio signal.

The sensing receiving unit 208 receives sensing data from the sensing unit 104 in a wired or wireless way. In case of wired, data is received through a certain cable, and, in case of wireless, receptions are carried out by using a wireless signal such as an RF signal and the like.

Figure 3:
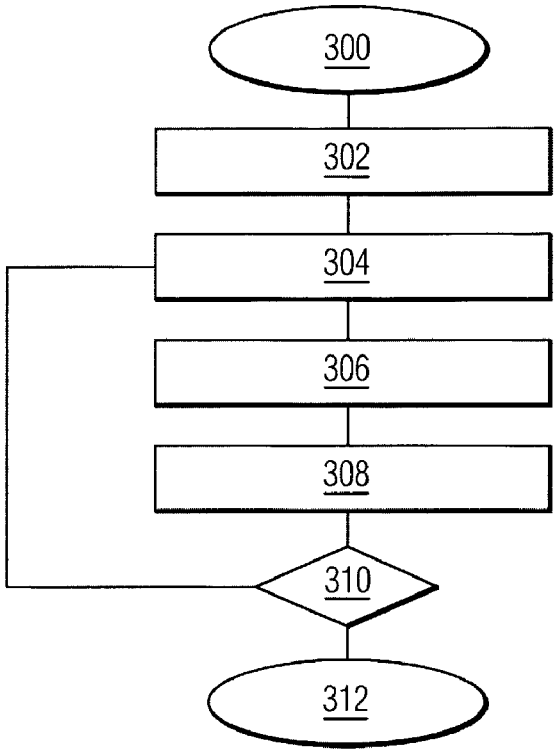
FIG. 3 is a flow chart for showing a process of the heart rate audio interval training device of FIG. 1.

FIG. 3 is a flow chart illustrating the operation steps of reference-based audio interval pacing.

As shown in FIG. 3, the process begins (start 300) with a user selecting an exercise level(s) or program in step 302. In step 304, the processing unit 102 receives heart rate information from the heart rate monitor and stores it in storage unit 206. The control unit 202 analyzes the receive heart rate information and compares it to the selected exercise levels in step 306. In particular, the control unit determines the heart rate of the user and at what stage or level the user is in the selected exercise program and determines whether the user needs to increase, decrease or maintain the current heart rate. In step 308, the control unit 202 selects an audio signal form storage unit 206 in accordance with the determination of step 306 and provides it to the user. In step 310, process determines whether the selected exercise program has ended (end 312) or returns to the step 304.

Figure 4:
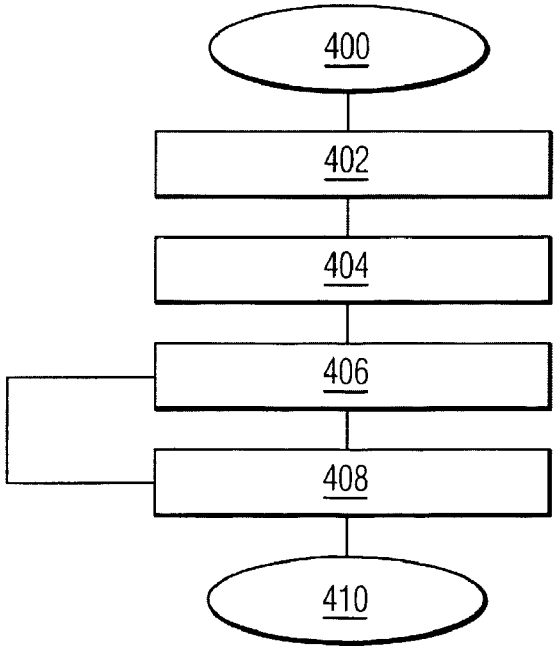
FIG. 4 is a flow chart illustrating the interval training operation steps of heart rate audio interval training.

FIG. 4 is a flow chart illustrating the interval training operation steps the audio interval training.

The interval training operation is initiated (START 400) by a user using the input/output port 106. The user sets a low and a high target parameter value (e.g. high and low heart rate, or high and low intensity time durations) in step 402. In step 404, the processing unit 102 selects the first (high tempo) and second (low tempo) audio signals based on their BPM values. For example, Page: 8 all audio signals are ordered based on their BPM, and the processing unit selects two songs: one out of the set of 10% slowest and one out of the fastest 10%. In addition, the processing unit can use the classification of songs (audio signals) by their tempo: slow, normal, up-tempo, and fast. Thus, selecting a song from the slow, and one from the up-tempo or even fast class. In step 406, the first (fast) audio signal is then rendered to the user until the user's heart rate reaches or exceeds the high target value, as determined by the processing unit 102 using a received heart rate from the heart rate monitor 104. Then the first audio signal is paused and the second (slow) audio signal is rendered, possibly with a few seconds of crossfading. In step 408, when the user's heart rate reaches or falls below the low BPM target value, as determined by the processing unit 102 using a received heart rate from the heart rate monitor 104, the second audio signal is paused and the first audio signal is continued. This process is repeated until the user indicates an end (END 410). When an audio signal, such as a song, ends, another audio signal of similar tempo (BPM) can be rendered, or the audio signal can be repeated.

Importantly, as noted above, a user may use any suitable target parameter value, for example, a time-interval based parameter value for the interval training. In particular, the user sets a first and second time-interval in step 402. In step 404, the processing unit 102 selects the first (high tempo) and second (low tempo) audio signals based on their BPM values. In step 406, the first (fast) audio signal is then rendered to the user for the first time-interval. Then the first audio signal is paused and the second (slow) audio signal is rendered. In step 408, after the second time-interval has been reached, the second audio signal is paused and the first audio signal is continued. This process is repeated until the user indicates an end (END 410). When an audio signal, such as a song, ends, another audio signal of similar tempo (BPM) can be rendered, or the same audio signal can be repeated.

The preceding and following merely illustrates the principles of the invention. It will thus be appreciated that those skilled in the art will be able to devise various arrangements which, although not explicitly described or shown herein, embody the principles of the invention and are included within its spirit and scope. Additionally, it is intended that such equivalents include both currently known equivalents as well as equivalents developed in the future, i.e., any elements developed that perform the same function, regardless of structure.

The functions of the various elements shown in FIGS. 1 and 2, may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor", "server" or "controller" should not be construed to refer exclusively to hardware capable of executing software, and may implicitly include, without limitation, digital signal processor (DSP) hardware, read-only memory (ROM) for storing software, random access memory (RAM) and non-volatile storage. Other hardware, conventional and/or custom, may also be included.

In the claims hereof any element expressed as a means for performing a specified function is intended to encompass any way of performing that function including, for example, a) a combination of circuit elements which performs that function or b) software in any form, including, downloadable or retrofit software or the like, combined with appropriate circuitry for executing that software to perform the function. The invention as defined by such claims resides in the fact that the functionalities provided by the various recited means are combined and brought together in the manner which the claims call for. Applicant thus regards any means which can provide those functionalities as equivalent as those shown herein.

The invention claimed is:

1. An audio interval training device, comprising:

a sensing unit to obtain a parameter of a user in physical exercise;

a memory to store a plurality of audio signals, each having a predetermined tempo value; and a processing unit configured to (1) receive the parameter from the sensing unit, (2) receive a first and second target parameter value, (3) select a first and second audio signals having a respective tempo corresponding to the first and second target parameter values, (4) rendering the first audio signal to the user at least until the processor determines the parameter has achieved the first parameter value, (5) rendering the second audio signal to the user at least until the processor determines the parameter has achieved the second parameter value, and (6) alternating the rendering of the first and second audio signals according to (4) and (5).

2. The audio interval training device as claimed in claim 1, wherein the parameter is a pulse rate.

3. The audio interval training device as claimed in claim 1, wherein the parameter is a time-interval.

4. The audio interval training device as claimed in claim 1, wherein the tempo is a beat per minute value.

5. The audio interval training device as claimed in claim 1, wherein the sensing unit is a heart rate monitor or a timer device.

6. The audio interval training device as claimed in claim 5, wherein a respective audio signal is rendered to the user until the user's heart rate reaches the first or second target heart rate, as determined by the processing unit using a received heart rate from the heart rate monitor.

7. The audio interval training device as claimed in claim 1, wherein the sensing unit and the processing unit are connected in a wired or wireless way.

8. The audio interval training device as claimed in claim 1, wherein the first and second target parameter value include target parameter value selected by a user or a programmed exercise routine.

9. The audio interval training device as claimed in claim 1, wherein the audio signals are annotated with their beat per minute value.

10. The audio interval training device as claimed in claim 1, wherein the tempo values of the plurality of audio signal are determined either by the audio interval training device, or by an external device and transferred to the audio interval training device.

11. The audio interval training device as claimed in claim 1, wherein the audio signals are encoded in an MP3, WAV, MPEG-4, WMA or AAC format.

12. An audio interval training method, comprising steps of:

receiving a first and second target parameter value;

receiving a parameter of a user in physical exercise from a sensing unit;

selecting a first and second audio signal having respective tempos from a plurality of audio signals, each having a predetermined tempo value, the first and second audio signals corresponding to the first and second target parameter values, respectively; and alternatively rendering the first audio signal to the user at least until a processor determines the parameter has achieved the first parameter value and the second audio signal to the user at least until the processor determines the parameter has achieved the second parameter value.

13. The audio interval training method as claimed in claim 12, further comprising the step of, a user, selecting the first and second target parameter value from a group of predetermined target parameter value or a programmed exercise routine that includes the first and second target parameter value.

14. The audio interval training method as claimed in claim 12, wherein the audio signals are encoded in an MP3, WAV, MPEG-4 or WMA format.

15. The audio interval training method as claimed in claim 12, further comprising the step of, selecting at least one of a further audio signal having respective tempos similar to the first and second audio signals.

16. The audio interval training method as claimed in claim 13, further comprising the step of, at a predetermined time, rendering at least one of a further audio signals in place of the first and second audio signals.

17. The audio interval training method as claimed in claim 12, wherein the parameter is a pulse rate or a time-interval.

* * * * *